US005474383A

United States Patent [19]

Zuege et al.

[11] Patent Number: 5,474,383

[45] Date of Patent: Dec. 12, 1995

[54] FLEXIBLE CONTAINER APPARATUS WITH SUBSTANTIALLY RECTANGULAR-BOTTOMED CONFIGURATION

[75] Inventors: John C. Zuege, West Lafayette; Dennis E. Stepp, Fowler, both of Ind.

[73] Assignee: AB Specialty Packaging, Inc., Hialeah, Fla.

[21] Appl. No.: 378,524

[22] Filed: Jan. 26, 1995

[51] Int. Cl.[6] ..... B65D 30/16; A23L 1/18

[52] U.S. Cl. ..... 383/121; 383/94; 383/120; 383/124; 383/903; 219/727; 426/107; 426/111

[58] Field of Search ..... 383/121, 123, 383/124, 104, 120, 94, 100, 101, 107, 125, 126, 903; 219/10.55 E; 426/107, 111

[56] References Cited

U.S. PATENT DOCUMENTS

| | | | |
|---|---|---|---|
| 1,995,286 | 3/1935 | Arzet | 383/124 |
| 2,041,227 | 5/1936 | Chalmers . | |
| 3,185,384 | 5/1965 | Ragan et al. | 383/124 |
| 3,237,844 | 3/1966 | Hughes . | |
| 3,372,859 | 3/1968 | Bjorkengren et al. . | |
| 3,437,258 | 4/1969 | Kugler . | |
| 3,719,318 | 3/1973 | Moran . | |
| 3,851,574 | 12/1974 | Katz et al. . | |
| 3,935,993 | 2/1976 | Doyen et al. . | |
| 3,970,241 | 7/1976 | Hanson . | |
| 4,353,497 | 10/1982 | Bustin . | |
| 4,450,180 | 5/1984 | Watkins . | |
| 4,450,581 | 5/1984 | Hirata . | |
| 4,479,243 | 10/1984 | Derby et al. . | |
| 4,548,826 | 10/1985 | Watkins . | |
| 4,691,374 | 9/1987 | Watkins et al. . | |
| 4,783,178 | 11/1988 | Herder . | |
| 4,849,040 | 7/1989 | Wood . | |
| 5,044,777 | 9/1991 | Watkins et al. . | |
| 5,165,799 | 11/1992 | Wood . | |
| 5,195,829 | 3/1993 | Watkins et al. . | |
| 5,326,576 | 7/1994 | Zuege | 383/120 X |

FOREIGN PATENT DOCUMENTS

| | | | |
|---|---|---|---|
| 81544 | 12/1956 | Denmark . | |
| 660889 | 11/1951 | United Kingdom | 383/123 |

*Primary Examiner*—Jes F. Pascua
*Attorney, Agent, or Firm*—Dick and Harris

[57] ABSTRACT

A flexible, sealable container apparatus having a substantially pinch-bottomed configuration prior to expansion of the bag during cooking. The container apparatus includes substantially quadrilateral regions of adhesive. The shape and positioning of the quadrilateral regions, with diagonals substantially collinear to panel edges of the container apparatus, serves to articulate the container apparatus into a substantially rectangular-bottomed configuration during cooking, while improving the integrity of the bottom region seals against blowout and/or leakage.

21 Claims, 3 Drawing Sheets

Fig 8
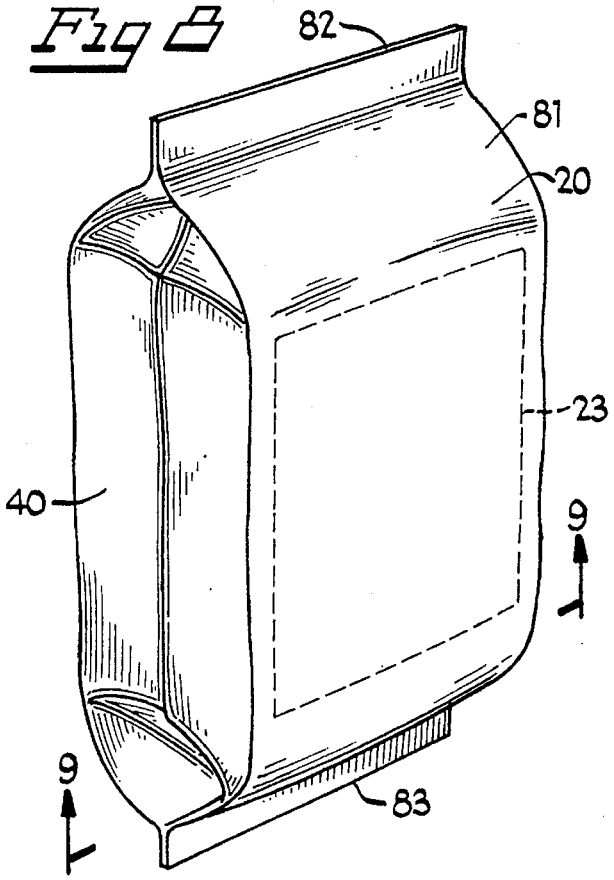
Fig 6
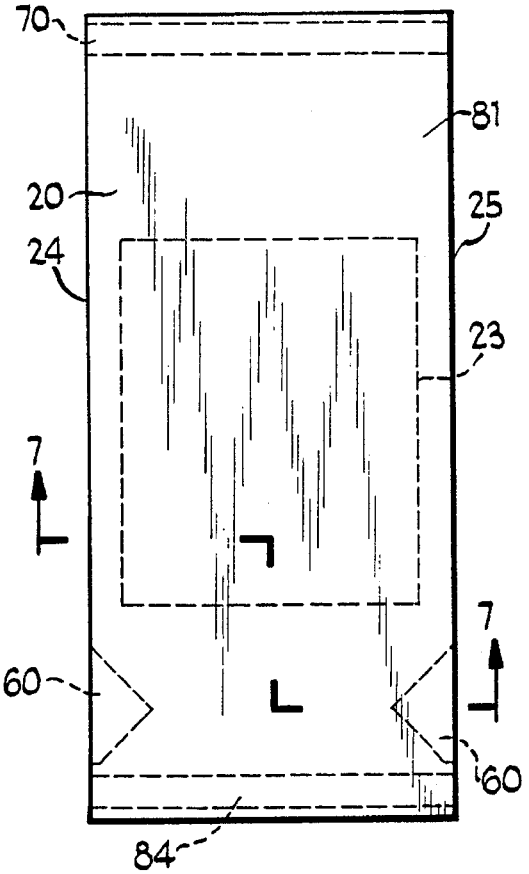
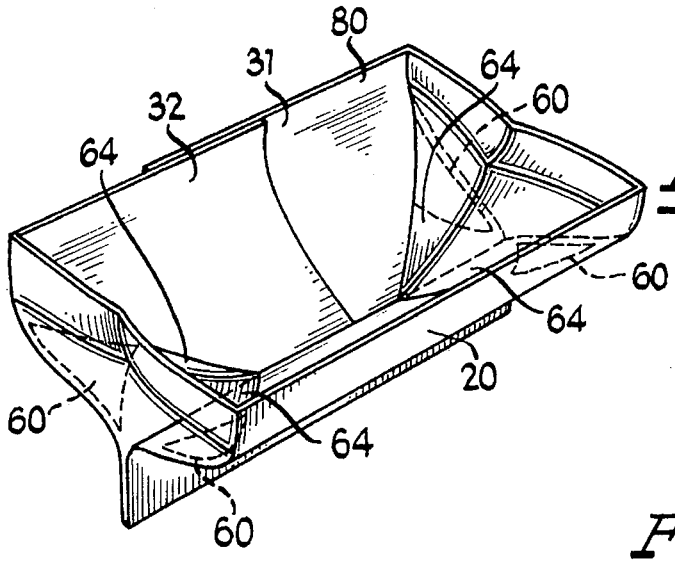
Fig 9
Fig 7
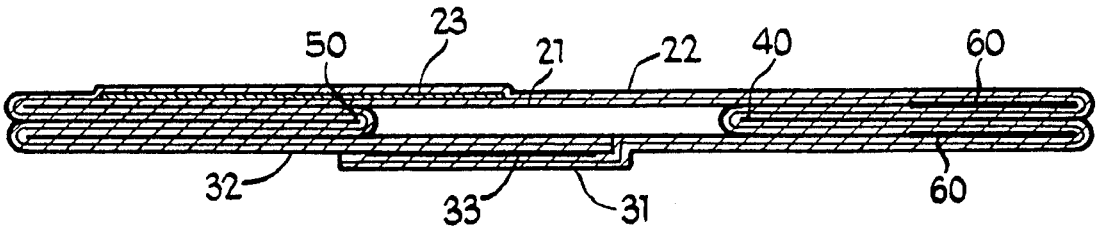

FLEXIBLE CONTAINER APPARATUS WITH SUBSTANTIALLY RECTANGULAR-BOTTOMED CONFIGURATION

BACKGROUND OF THE INVENTION

The present invention relates to container apparatuses, and, more particularly, to sealable, flexible container apparatuses having substantially rectangular bottomed configurations when fully deployed.

Containers having substantially rectangular bottoms when fully deployed are well known in the art. Examples of such prior art containers are Watkins et al., U.S. Pat. No. 5,044,777; Watkins et al., U.S. Pat. No. 4,450,180; Watkins et al., U.S. Pat. No. 4,691,374; and Danish Patent No. 815,442 to Honsfl. Each reference discloses an erectable container having gusseted side panels, with various embodiments of triangular regions of adhesive sealing the gussets to front and back panels of the container in a pinch-bottomed configuration. Upon deployment of such containers, such as by the expansion of gases while microwave cooking food articles contained within the containers, the deployed bottom of the container has a relatively flat, rectangular-bottomed configuration. These triangular regions of adhesive seal the entirety of the lower portions of the gusseted side panels to front and back panels of the container, potentially reducing the overall volumetric capacity of the bag, and, in turn, reducing the space for gases to expand into during the cooking process. This could in turn result in a relatively rapid increase in the concentration of localized pressure proximate the bottom of the bag, due to the expanding gases, increasing the likelihood of leakage of gases and food articles through and beyond a bottom seal of the container.

Accordingly, it is an object of the present invention to provide a sealable, flexible container apparatus having a substantially rectangular bottomed configuration when fully deployed.

It is another object of the present invention to provide a container apparatus with improved resistance against the unintentional leakage of pressure and cooking articles through and beyond a bottom seal of the container apparatus; in a variety of adhesive embodiments including the use of cohesive bonding agents.

These and other objects of the present invention will become apparent in light of the present specification, claims and drawings.

SUMMARY Of THE INVENTION

The present invention comprises a sealable, flexible container apparatus for use in storing, shipping and cooking various articles contained therewithin in an oven, such as a microwave oven. The container apparatus has an exterior and an interior structure for converting a substantially pinch-ended bottom into a rectangular bottomed bag configuration during cooking of the food articles contained within.

Bag means are provided for containing the articles. The bag means includes a front panel, a back panel, a first gusseted side panel, a second gusseted side panel, and a longitudinal axis which is substantially parallel to each of the front panel, back panel, first gusseted side panel, and second gusseted side panel. Each of the front, back and gusseted side panels has an interior surface, an exterior surface, a top edge and a bottom edge. The top and bottom edges of each of the front, back, and gusseted side panels collectively define a top and bottom of the container apparatus.

The front and back panels each have a first side edge and a second side edge, with the first and second side edges being substantially parallel to each other. Moreover, the front and back panels are positioned opposite each other, and are operably connected at their respective first and second side edges to the first and second gusseted side panels, respectively, so as to form a substantially tubular configuration.

First sealing means, substantially transverse to the longitudinal axis, are provided for permanently sealing each of the front, back and gusseted side panels to one another proximate to their respective bottom edges. The first sealing means operably connects the front, back and gusseted side panels, to collectively seal the bottom of the sealable container apparatus.

Second sealing means are provided for converting the substantially pinch-ended bottom of the container apparatus to the substantially rectangular bottomed bag configuration, and for permanently sealing each of the first, second and gusseted side panels to each of the front and back panels, at the interior surfaces of the front, back, and first and second gusseted side panels, at a position proximate to the bottom of the container apparatus.

The second sealing means comprises a plurality of substantially quadrilateral regions, with each quadrilateral region being positioned so as to dispose a diagonal of the quadrilateral region substantially collinear to a corresponding side edge of at least one of the front and back panels, proximate the first sealing means.

This positioning of the plurality of substantially quadrilateral regions serves to articulate the bottom of the container apparatus into a substantially rectangular configuration upon expansion of the bag means, due to pressure generated by cooking the articles contained within the container apparatus. Simultaneously, pressure resulting from the cooking of these cooking articles is believed to be distributed substantially uniformally proximate the bottom of the bag, improving resistance against unintentional leakage of pressure and cooking articles through and beyond the first sealing means.

In the preferred embodiments, four substantially quadrilateral regions are provided. A first substantially quadrilateral region has a diagonal substantially collinear to the first edge of the front panel. A second substantially quadrilateral region has a diagonal substantially collinear to the second edge of the front panel. A third substantially quadrilateral region has a diagonal substantially collinear to the first edge of the back panel, and a fourth substantially quadrilateral region has a diagonal substantially collinear to the second edge of the back panel.

Also, in the preferred embodiments, the substantially quadrilateral regions have a substantially rectangular configuration. This substantially rectangular configuration is preferably a substantially square configuration.

In one preferred embodiment, the first and second substantially quadrilateral regions each further include a central void region substantially encompassing their respective diagonals which are substantially collinear to corresponding first and second edges of the front panel.

In another preferred embodiment, the plurality of substantially quadrilateral regions abut the first sealing means. In yet another preferred embodiment, each of the plurality of substantially quadrilateral regions is proximate to, but does not abut, the first sealing means.

The front panel preferably includes heat enhancing means associated with the front panel for intensifying and concentrating heat within the container apparatus. The front panel is preferably constructed of a plurality of plys including a first ply and a second ply, with the heat enhancing means operably disposed between the first and second plys. The heat enhancing means preferably comprises a microwave absorbent material.

Third sealing means, substantially transverse to the longitudinal axis, are provided in the preferred embodiments, for releasably sealing each of the front, back and side panels proximate to the top edge of each of the front and back panels. The third sealing means operably connects the front, back and side panels to collectively seal the top of the container apparatus.

In the preferred embodiments, the back panel portion comprises a first back panel portion and a second back panel portion. A fourth sealing means, substantially parallel to the longitudinal axis, is provided for permanently sealing the first and second back panels to each other, so as to form the substantially tubular configuration of the container apparatus.

Also, in the preferred embodiments, the bag means is constructed of a substantially paper material. The fourth sealing means is preferably constructed from a heat sealable adhesive material. The first, second and third sealing means may each be constructed of a cohesive material, substantially incapable, upon curing, of bonding directly to a paper surface, but rather sealable only to a corresponding aligned and abutting layer of like, cured cohesive material. Alternatively, the first, second and third sealing means may be constructed of a heat sealable adhesive material.

BRIEF DESCRIPTION OF THE DRAWINGS

FIG. 6 of the drawings is an elevated side view of the articulated container apparatus of FIG. 3 prior to cooking;

FIG. 7 of the drawings is a sectional bottom plan view of the container apparatus of FIG. 6, taken generally along lines 7—7 of FIG. 6 and looking in the direction of the arrows;

FIG. 8 of the drawings is a perspective view of the substantially deployed container apparatus of FIG. 6; and FIG. 9 of the drawings is a sectional, perspective view of the bottom of the deployed container apparatus of FIG. 8, upon full deployment, taken generally long lines 9—9 of FIG. 8.

DETAILED DESCRIPTION OF THE DRAWINGS

Figure 2:
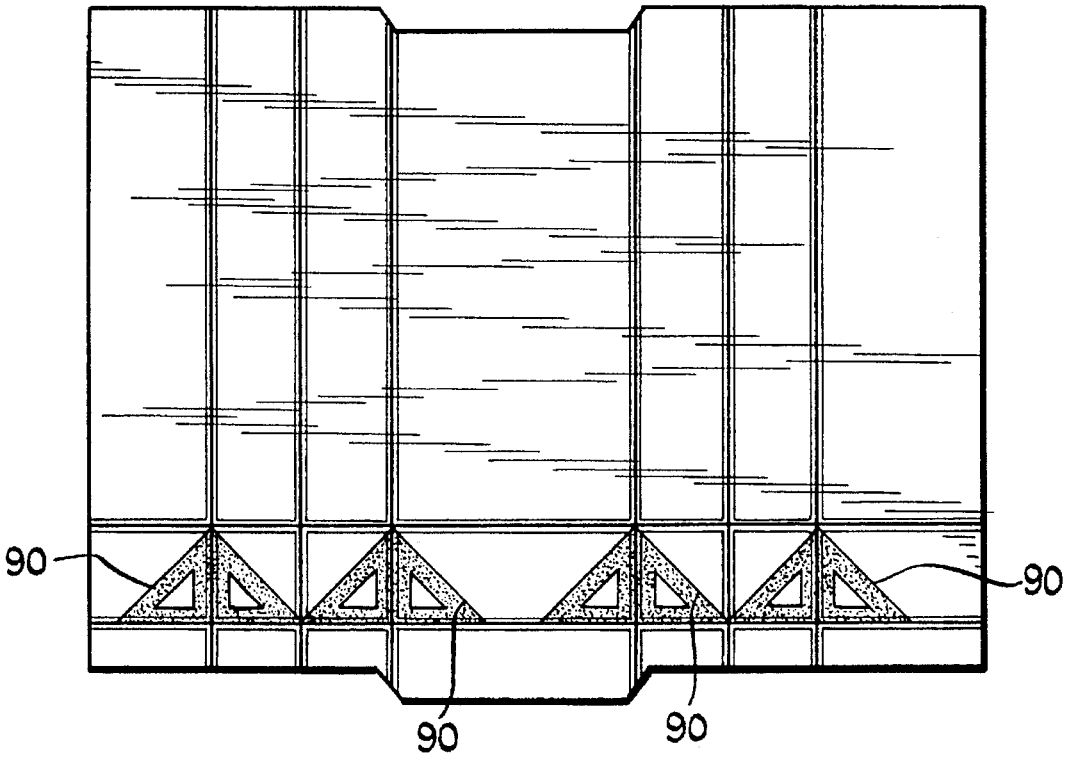
Fig 2 PRIOR ART
FIG. 2 of the drawings is an elevated side view of an unerected blank of another prior art container apparatus.

While this description is susceptible of embodiment in many different forms, there is shown in the drawings and will herein be described in detail, several specific embodiments, with the understanding that the present invention is to be considered as an exemplification of the principles of the invention and is not intended to limit the invention to the embodiments illustrated.

Figure 1:
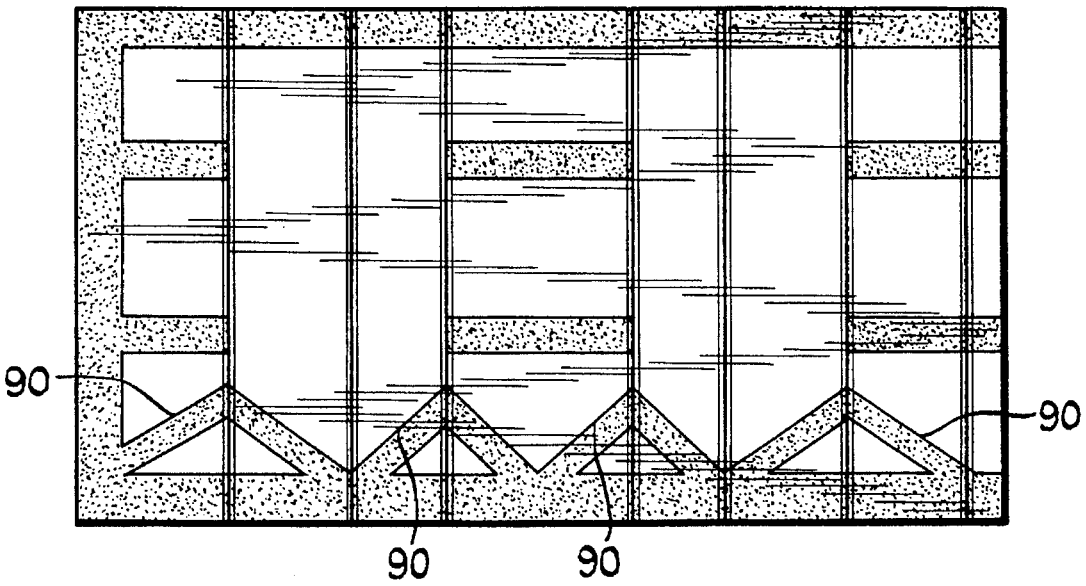
Fig 1 PRIOR ART
FIG. 1 of the drawings is an elevated side view of an unerected blank of a prior art container apparatus.

Two prior art unerected blanks for forming rectangular-bottomed containers, each having a plurality of triangular regions 90 of adhesive, are shown in FIGS. 1 and 2. The container of FIG. 1 is disclosed within FIG. 1 of U.S. Pat. No. 4,691,374 to Watkins et al. The container in FIG. 2 is disclosed within FIG. 1 of Danish Patent No. 815,442 to Honsfl. In each prior art container, triangular regions 90 serve to convert the erected containers into substantially rectangular-bottomed configurations upon deployment of the containers. Inasmuch as the diagonal edges of the triangular regions extend from the bottom of the containers to fold lines adjacent gusseted side panels, the entire lower portion of the gusseted side panels are sealed to front and back panels of the containers. Accordingly, no open regions, or pockets, are formed underneath the gusset folds, proximate the rectangular bottom of the deployed containers.

Figure 3:
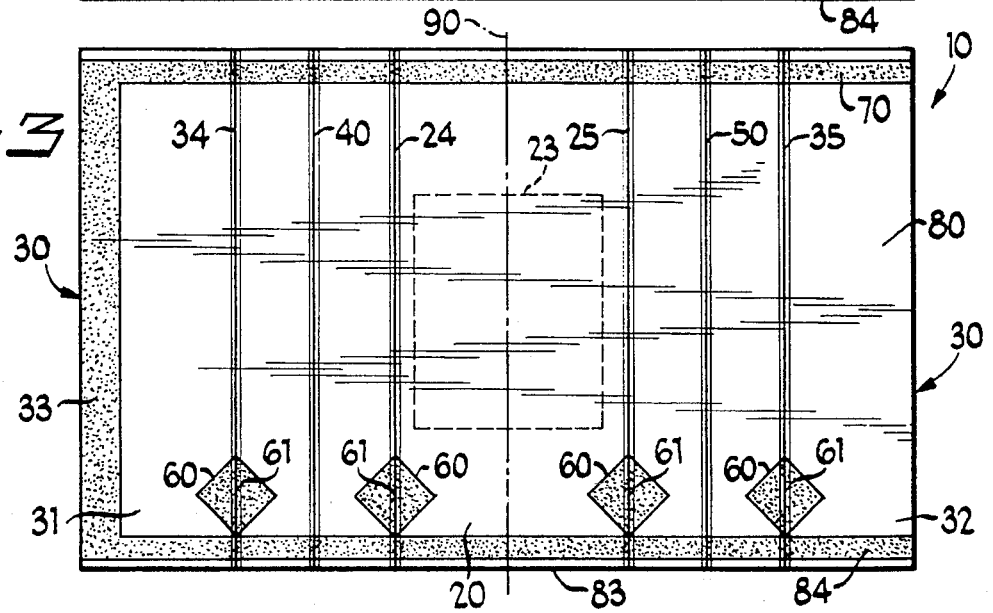
FIG. 3 of the drawings is an elevated side view of an unerected blank for forming the present container apparatus.

An unerected blank, for forming one embodiment of the present sealable, flexible container apparatus 10, is shown in FIG. 3 as comprising front panel 20, back panel 30, first gusseted side panel 40, and second gusseted side panel 50. Front panel 20 includes first side edge 24 and second side edge 25. Back panel 30 includes first side edge 34 and second side edge 35. As shown in FIG. 3, first side edge 24 is substantially parallel to second side edge 25, and first side edge 34 is substantially parallel to second side edge 35. Container apparatus 10 further includes longitudinal axis 90, which is substantially parallel to the length of each of front panel 20, back panel 30, and side panels 40 and 50. Moreover, as shown in FIG. 3, first gusseted side panel 40 and second gusseted side panel 50 each comprise two separate side panels, joined by a center gusset fold.

Front panel 20 and back panel 30 are operably connected by first gusseted side panel 40 and second gusseted side panel 50. First gusseted side panel 40 connects first side edge 24 of front panel 20 to first side edge 34 of back panel 30. Similarly, second gusseted side panel 50 connects second side edge 25 of front panel 20 to second side edge 35 of back panel 30.

Container apparatus 10 further comprises four distinct sealing means, which, in the preferred embodiments, comprise four distinct regions of adhesive or cohesive material. A first sealing means, adhesive region 84, extends the width of container apparatus 10 and is substantially transverse to longitudinal axis 90, for permanently sealing each of front panel 20, back panel 30, and gusseted side panels 40 and 50 to one another proximate their respective bottom edges, operably connecting front panel 20, back panel 30, first gusseted side panel 40, and second gusseted side panel 50 to collectively seal the bottom 83 of container apparatus 10. Region 84 accordingly forms the substantially pinch-bottomed configuration of the erected container apparatus 10 upon articulation of the unerected blank of FIG. 3 into the tubular configuration of FIG. 6.

A second sealing means, comprising a plurality of adhesive regions 60, are provided for permanently sealing each of first gusseted side panel 40 and second gusseted side panel 50 to front panel 30 and back panel 40, at the interior surface 80 of container apparatus 10, and at a position proximate to bottom 83 of container apparatus 10.

As shown in FIG. 3, adhesive regions 60, in the preferred embodiments, comprises four separate, substantially quadrilateral regions of adhesive. Each quadrilateral region is positioned to dispose a diagonal 61 (a line bisecting opposing corners of quadrilateral 60) of each quadrilateral region substantially collinear to a corresponding side edge of front panel 20 or back panel 30. In particular, a diagonal 61 of a quadrilateral region 60 of adhesive is disposed to be substantially collinear to each of first side edge 24 of front panel 20, second side edge 25 of front panel 20, first side edge 34 of back panel 30, and second side edge 35 of back panel 30.

This positioning of each substantially quadrilateral region 60 serves to articulate the bottom 83 of container apparatus 10 into a substantially rectangular, flat-bottomed configuration upon expansion of pressure generated by the cooking of articles contained within container apparatus 10.

Figure 4:
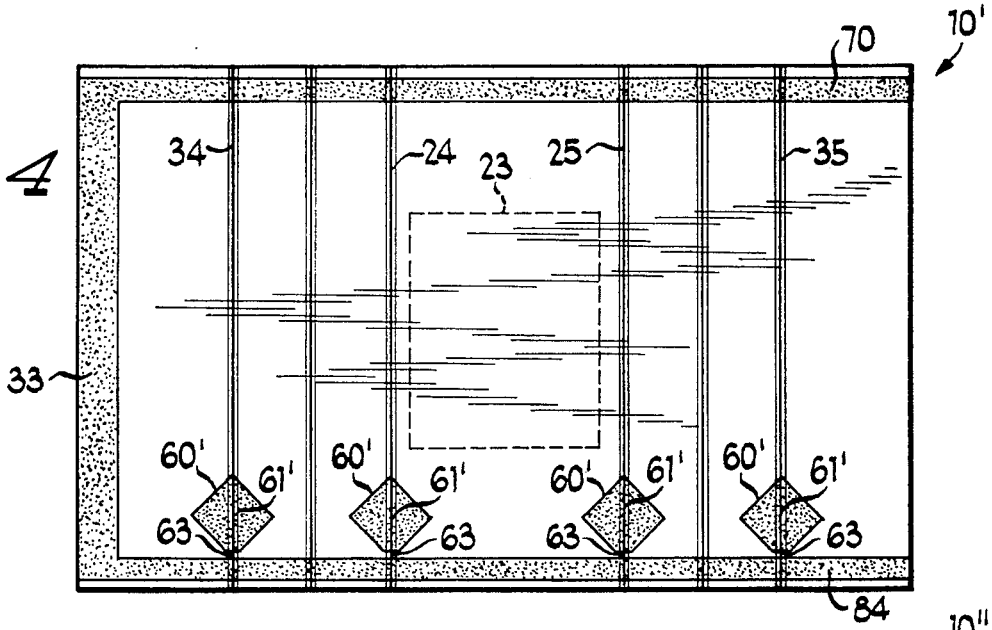
FIG. 4 of the drawings is an elevated side view of an unerected blank of another embodiment of the present container apparatus.
Figure 5:
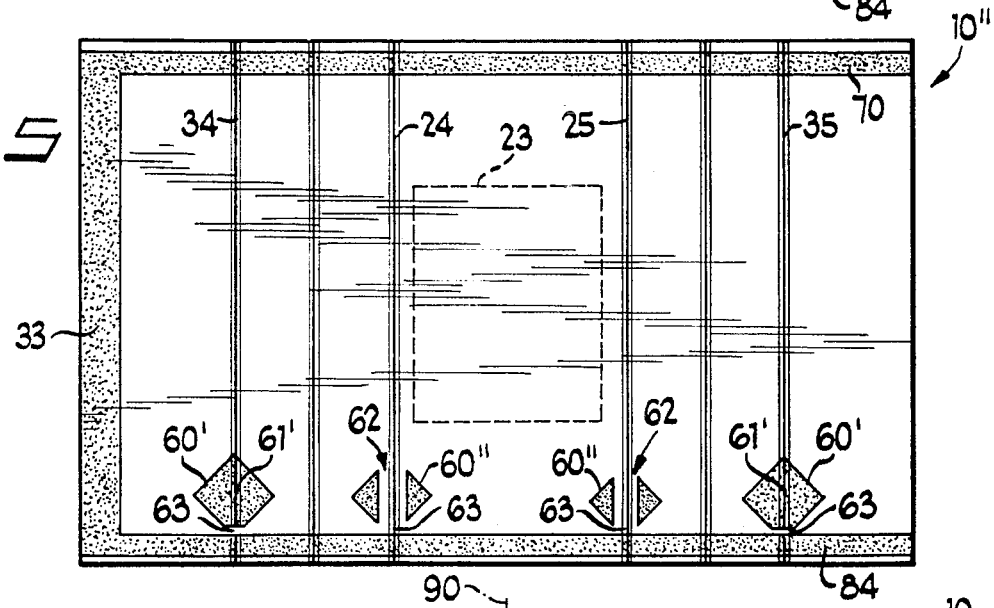
FIG. 5 of the drawings is an elevated side view of an unerected blank of yet another embodiment of the present container apparatus.

In the preferred embodiments shown in FIGS. 3–5, each substantially quadrilateral region 60 has a substantially square, rectangular configuration.

A third sealing means, adhesive region 70, is substantially transverse to longitudinal axis 90 and is provided for releasably, substantially sealing each of front panel 20, back panel 30, and gusseted side panels 40 and 50 to each other proximate top edge 82 of container apparatus 10. Adhesive region 70 is sealed following the introduction of cooking articles into the erected, tubular configured container apparatus.

As shown in FIGS. 3–5, back panel 30, in the preferred embodiments, comprises first back panel portion 31 and second back panel portion 32. First back panel portion 31 includes a fourth sealing means, adhesive region 33, positioned substantially parallel to longitudinal axis 90 and adjacent a side edge of first back panel portion 31. Adhesive region 33 permanently seals first back panel portion 31 and second back panel portion 32 to each other, so as to form a substantially tubular, erected bag configuration, as shown in FIGS. 6 through 9. Upon such articulation of the bag blank of FIG. 10 into a tubular bag apparatus, as shown in FIGS. 6 and 7, front panel 20 and back panel 30 are substantially parallel to each other. Gusseted side panels 40 and 50 are each folded inwardly, with their respective center gusset folds positioned towards the center of front panel 20 and back panel 30. The erected, articulated container apparatus 10 accordingly has a substantially flat, rectangular configuration, as shown in FIGS. 6 and 7. Moreover, upon such articulation of the blank of FIG. 3 into the tubular-configured bag apparatus shown in FIGS. 6 and 7, corresponding halves of each adhesive region 60, on opposing sides of an associated side edge (side edges 24, 34, 25, or 35), and, in turn, opposing sides of diagonal 61, are placed into abutting contact.

Adhesive regions 60 may comprise a cohesive material, substantially incapable, upon curing, of bonding directly to paper, but sealable to a corresponding aligned and abutting layer of like cohesive material. Accordingly, the abutment of corresponding portions of each quadrilateral adhesive region 60 causes the corresponding portions to bond together, when such adhesive regions comprise a cohesive material. Alternatively, adhesive regions 60 may comprise a heat-sealable adhesive material, such as a polyvinyl acetate material. In such a case, the application of heat, following articulation of the blank into the tubular configuration, is required in order to seal the abutting halves of each articulated adhesive region 60.

Adhesive regions 70 and 84 may similarly comprise either a heat-sealable material or a cohesive material. Adhesive region 33 is preferably a heat-sealable material.

The articulation of the blank of FIG. 1 into a tubular-configured container apparatus causes abutting portions of adhesive region 84, disposed along the bottom portions of front panel 20, back panel 30, and gusseted side panels 40 and 50, to be adhered to overlapping, juxtaposed portions, creating a permanently sealed, closed bottom to container apparatus 10. If adhesive region 84 comprises a heat-sealable material, rather than a cohesive material, an application of heat, following articulation, is required to seal the overlapping portions of adhesive region 84.

Container apparatus 10 further includes heat enhancing means, namely microwave-absorbent material 23, for intensifying and concentrating heat within container apparatus 10. Microwave-absorbent material 23 may comprise, for example, a sheet of metalized mylar material. In the preferred embodiments, as shown in FIG. 7, bag apparatus 10 comprises two layers of paper material, comprising inner ply 21 and outer ply 22. As shown in FIG. 7, the microwave-absorbent material 23 is disposed within front panel 20, between first ply 21 and second ply 22, in a substantially centered orientation with respect to front panel 20. During cooking of articles contained within container apparatus 10, such as within a microwave oven, microwave-absorbent material 23 concentrates heat, generated by the microwave energy, in a centered region proximate front panel 20, proximate a location within container apparatus 10 in which the articles to be cooked are located.

Upon cooking of such food articles, such as popcorn, the gases and food articles contained within the interior of cooking apparatus 10 expand, bringing bag apparatus 10 from a substantially undeployed position (FIG. 6) to a substantially rectangular-bottomed, deployed position (FIG. 8), shown fully deployed in FIG. 9. As shown in both FIGS. 8 and 9, the substantially quadrilateral configuration of adhesive regions 60 result in a substantially rectangular, flat-bottomed interior of container apparatus 10 upon such deployment. In particular, relatively square bottom corners are formed by the adhesion of bottom portions of the gusseted side panels to the front and back panels, proximate first edges 24 and 34, and second edges 25 and 35 of front panel 20 and back panel 30.

Moreover, the square, rectangular, quadrilateral configuration of adhesive regions 60 create open regions, or pockets, beneath the four interior bottom corners created upon deployment of container apparatus 10 into its substantially rectangular bottomed configuration. As shown in FIG. 9, four pockets 64 are created beneath bottom portions of gusseted side panels 40 and 50, adjacent corresponding adhesive regions 60. It is believed that the pockets and/or the shape and orientation of the quadrilateral adhesive regions more efficiently distributes the pressures generated during cooking over all the bottom seals—to reduce the likelihood of pressure blowout and/or leakage at any one point of concentration—as could be prompted by the prior art triangular, base-hugging seals. Additionally, the present invention is believed to accommodate the preservation of bag-bottom integrity while using less adhesive materials, at a savings of material costs, in an environment which permits use of cohesive compounds yielding bag formation efficiencies. Accordingly, the pressure of expanded gases created during cooking is believed to be distributed more uniformly proximate the bottom of the bag. This, in turn, is believed to improve resistance against the unintentional leakage of pressure and cooking articles through and beyond adhesive region 84, particularly at the intersection of folds 24, 25, 34 and 35 with bottom seal 84, and at bottom 83 of the bag. This is believed accomplished by reducing localized rapid increases in pressure proximate vulnerable regions at the bottom of the container apparatus.

Moreover, the use of quadrilateral adhesive regions 60, rather than the prior art triangular adhesive regions, requires less overall adhesive in order to form the substantially rectangular bottomed configuration of the deployed container.

An alternative preferred embodiment of the present container apparatus is shown in FIG. 4 as container apparatus blank 10'. In this preferred embodiment, a relatively small bottom portion of each quadrilateral adhesive region 60 is removed, creating corresponding lower void regions 63. In this preferred embodiment, each adhesive region 60 retains its substantial quadrilateral configuration. However, in this preferred embodiment, each substantially quadrilateral adhesive region 60 does not abut adhesive region 84, but is instead spaced slightly distally from adhesive region 84, rather than abutting adhesive region 84, as in the preferred embodiment of FIG. 3. When fully articulated and deployed, the shipping container apparatus blank 10' shown in FIG. 4 will retain the substantially rectangular, flat-bottomed configuration of FIG. 9.

Yet another preferred embodiment of the present invention is shown in FIG. 5 as container apparatus blank 10". In this preferred embodiment, each adhesive region 60 is again distally spaced from adhesive region 84 by corresponding lower void regions 63. Moreover, in this preferred embodiment, the two center, substantially quadrilateral regions of adhesive 60, having diagonals substantially collinear to first side 24 and second side 25 of front panel 20, each have an absent center region of adhesive, forming central void region 62. These two center adhesive regions 60' still retain a substantially quadrilateral configuration. Moreover, the container apparatus blank 10" of FIG. 3, when articulated into a tubular-configuration and fully deployed, still retains the substantially rectangular, flat-bottomed configuration of FIG. 9.

The foregoing description and drawings merely explain and illustrate the invention and the invention is not limited thereto, except insofar as the appended claims are so limited, as those skilled in the art have the disclosure before them will be able to make modifications and variations therein without departing from the scope of the invention.

What is claimed is:

1. A sealable, flexible container apparatus for use in storing, shipping and cooking various articles contained therewithin in an oven, said container apparatus having an exterior and an interior structure for converting a substantially pinch-ended bottom into a rectangular bottomed bag configuration during cooking of the articles contained therewithin, said container apparatus comprising:

bag means for containing said articles, said bag means including a front panel, a back panel, a first gusseted side panel, a second gusseted side panel, and a longitudinal axis substantially parallel to each of said front panel, back panel, first gusseted side panel, and second gusseted side panel, each of said front, back and side panels having an interior surface, an exterior surface, a top edge and a bottom edge, said top and bottom edges of said front, back and gusseted side panels collectively defining a top and a bottom of said container apparatus, respectively, said front and back panels each having a first side edge and a second side edge, said first and second side edges being substantially parallel to each other, said front and back panels positioned opposite each other and connected at said respective first and second side edges to said first and second gusseted side panels, respectively, so as to form a substantially tubular configuration;

first sealing means substantially transverse to said longitudinal axis for permanently sealing each of said front, back, and gusseted side panels to one another proximate to said respective bottom edges of each of said front, back, and side panels, said first sealing means connecting said front, back and gusseted side panels to collectively seal said bottom of said sealable container apparatus; and second sealing means for converting said substantially pinch-ended bottom to said substantially rectangular bottomed bag configuration and for permanently sealing each of said first and second gusseted side panels to each of said front and back panels, at said interior surfaces of said front, back, and first and second gusseted side panels, at a position proximate to said bottom of said sealable container apparatus, said second sealing means comprising a plurality of substantially quadrilateral regions, each of said substantially quadrilateral regions being positioned so as to dispose a diagonal of said quadrilateral region substantially collinear to a corresponding side edge of at least one of said front and back panels and proximate said first sealing means, said positioning of said plurality of substantially quadrilateral regions serving to articulate said bottom of said container apparatus into a substantially rectangular configuration upon expansion of said bag means upon pressure generated by cooking said articles contained therewithin, while simultaneously distributing said pressure resulting from said cooking of said cooking articles substantially uniformly proximate said bottom of said bag, to, in turn, improve resistance against the unintentional leakage of at least one of said pressure and said cooking articles through and beyond said first sealing means.

2. The invention according to claim 1 wherein said plurality of substantially quadrilateral regions comprises four substantially quadrilateral regions including:

a first substantially quadrilateral region having a diagonal substantially collinear to said first edge of said front panel;

a second substantially quadrilateral region having a diagonal substantially collinear to said second edge of said front panel;

a third substantially quadrilateral region having a diagonal substantially collinear to said first edge of said back panel; and a fourth substantially quadrilateral region having a diagonal substantially collinear to said second edge of said back panel.

3. The invention according to claim 1, wherein at least one of said plurality of substantially quadrilateral regions has a substantially rectangular configuration.

4. The invention according to claim 3, wherein said substantially rectangular configuration is a substantially square configuration.

5. The invention according to claim 1, wherein at least one of said substantially quadrilateral regions further includes a central void region substantially encompassing said diagonal being substantially collinear to said corresponding side edge.

6. The invention according to claim 2, wherein:

said first substantially quadrilateral region further includes a first central void region substantially encompassing said diagonal substantially collinear to said first edge of said front panel; and said second substantially quadrilateral region further includes a second central void region substantially encompassing said diagonal substantially collinear to said second edge of said from panel.

7. The invention according to claim 1 wherein each of said plurality of substantially quadrilateral regions abuts said first sealing means.

8. The invention according to claim 1 wherein each of said plurality of substantially quadrilateral regions is proximate to and does not abut said first sealing means.

9. The invention according to claim 1 wherein said second sealing means comprises a cohesive material substantially incapable, upon curing, of bonding directly to a paper surface, but rather sealable to a corresponding aligned and abutting layer of like, cured cohesive material.

10. The invention according to claim 1, wherein said second sealing means comprises a heat sealable adhesive material.

11. The invention according to claim 1 wherein said front panel further includes heat enhancing means associated with said front panel for intensifying and concentrating heat within said container apparatus.

12. The invention according to claim 11 wherein said front panel is constructed of a plurality of plies including a first ply and a second ply, said heat enhancing means being operably disposed between said first and second plies.

13. The invention according to claim 11 wherein said heat enhancing means comprises a microwave absorbent material.

14. The invention according to claim 1 wherein said container apparatus further includes a third sealing means substantially transverse to said longitudinal axis for releasably sealing each of front, back, and side panels proximate to said top edge of each of said front and back side panels, said third sealing means connecting said front, back and side panels to collectively, substantially seal said top of said container apparatus.

15. The invention according to claim 1 wherein said back panel portion comprises a first back panel portion and a second back panel portion:

said container apparatus further including a fourth sealing means substantially parallel to said longitudinal axis for permanently sealing said first and second back panel portions to each other so as to form said substantially tubular configuration.

16. The invention according to claim 1 wherein said first sealing means comprises a heat sealable adhesive material.

17. The invention according to claim 1, wherein said first sealing means comprises a cohesive material substantially incapable, upon curing, of bonding directly to a paper surface, but rather sealable to a corresponding aligned and abutting layer of like, cured cohesive material.

18. The invention according to claim 14 wherein said third sealing means comprises a heat sealable adhesive material.

19. The invention according to claim 14, wherein said third sealing means comprises a cohesive material substantially incapable, upon curing, of bonding directly to a paper surface, but rather sealable to a corresponding aligned and abutting layer of like, cured cohesive material.

20. The invention according to claim 15 wherein said fourth sealing means comprises a heat sealable adhesive material.

21. The invention according to claim 1, wherein said bag means is constructed of a substantially paper material.

* * * * *

UNITED STATES PATENT AND TRADEMARK OFFICE

CERTIFICATE OF CORRECTION

PATENT NO. : 5,474,383

DATED : December 12, 1995

INVENTOR(S) : John C. Zuege and Dennis E. Stepp

It is certified that error appears in the above-indentified patent and that said Letters Patent is hereby corrected as shown below:

Col. 7, Line 29 "regions 60' still"
should read -- regions 60" still --

Signed and Sealed this

Thirteenth Day of August, 1996

*Attest:*

Bruce Lehman

BRUCE LEHMAN

*Attesting Officer*

*Commissioner of Patents and Trademarks*